United States Patent [19]

Dube et al.

[11] Patent Number: 4,941,486

[45] Date of Patent: Jul. 17, 1990

[54] CIGARETTE HAVING SIDESTREAM AROMA

[76] Inventors: Michael F. Dube, 1641 Eaglecrest Dr., Pfafftown, N.C. 27040; Barry L. Saintsing, Rte. 8, Lexington, N.C. 27292

[21] Appl. No.: 145,724

[22] Filed: Jan. 15, 1988

Related U.S. Application Data

[63] Continuation-in-part of Ser. No. 827,568, Feb. 10, 1986.

[51] Int. Cl.[5] ..... A24B 3/12; A24D 1/02

[52] U.S. Cl. ..... 131/365; 131/276; 131/336

[58] Field of Search ..... 131/365, 276, 336

[56] References Cited

U.S. PATENT DOCUMENTS

| | | | |
|---|---|---|---|
| 3,006,347 | 10/1961 | Keaton | 131/276 |
| 3,162,199 | 12/1964 | Moll, Jr. . | |
| 3,332,428 | 7/1967 | Mold et al. . | |
| 3,419,543 | 12/1968 | Mold et al. . | |
| 3,499,452 | 3/1970 | Kallianos et al. . | |
| 3,540,456 | 11/1970 | McGlumphy et al. | 131/337 |
| 3,603,319 | 9/1971 | Badgett et al. . | |
| 3,635,226 | 1/1972 | Horsewell et al. . | |
| 3,744,496 | 7/1973 | McCarty et al. . | |
| 3,938,531 | 2/1976 | von Castelmur . | |
| 3,972,335 | 8/1976 | Tiggelbeck . | |
| 4,082,098 | 4/1978 | Owens, Jr. . | |
| 4,108,151 | 8/1978 | Martin et al. . | |
| 4,184,495 | 1/1980 | Rainer et al. . | |
| 4,225,636 | 9/1980 | Cline et al. . | |
| 4,231,377 | 11/1980 | Cline et al. . | |
| 4,236,532 | 12/1980 | Schweizer et al. . | |
| 4,281,671 | 8/1981 | Bynre et al. . | |
| 4,318,417 | 3/1982 | Hiroshi et al. . | |
| 4,420,002 | 12/1983 | Cline . | |
| 4,433,697 | 2/1984 | Cline et al. . | |
| 4,450,847 | 5/1984 | Owens . | |
| 4,453,553 | 6/1984 | Cohn . | |
| 4,461,311 | 7/1984 | Mathews et al. . | |
| 4,466,451 | 8/1984 | Bonnet et al. . | |
| 4,476,807 | 10/1984 | Pryor . | |
| 4,481,960 | 11/1984 | Brooks . | |
| 4,525,385 | 6/1985 | Pryor . | |
| 4,549,875 | 10/1985 | Pryor . | |
| 4,561,454 | 12/1985 | Guess . | |
| 4,624,268 | 11/1986 | Baker et al. . | |
| 4,637,410 | 1/1987 | Luke . | |
| 4,643,205 | 2/1987 | Redding et al. . | |
| 4,715,390 | 12/1987 | Nichols et al. . | |
| 4,721,120 | 1/1988 | Greig et al. . | |
| 4,804,002 | 2/1989 | Herron | 131/365 |

FOREIGN PATENT DOCUMENTS

| | | |
|---|---|---|
| 8201585 | 11/1982 | Netherlands . |
| 475418 | 8/1969 | Switzerland . |
| 1508616 | 4/1978 | United Kingdom . |

*Primary Examiner*—V. Millin

[57] ABSTRACT

Cigarette sidestream smoke can have the aroma thereof altered by placing the cigarette wrapping paper in intimate contact with a flavor precursor such as ethyl vanillin glucoside. The cigarettes exhibit good tobacco taste during use. The flavor precursor provides no substantial aroma to the cigarette prior to use thereof, and a characteristic aroma of the flavoring agent in the sidestream smoke during use thereof. Cigarettes can have a wrapping paper containing magnesium oxide and/or magnesium hydroxide, the paper having a net permeability of greater than 50 CORESTA units and an inherent permeability of less than 45 CORESTA units. The paper containing magnesium oxide and/or magnesium hydroxide is in intimate contact with a flavor precursor, and the filter of the cigarette includes a flavor carrier such as a flavored pellet.

28 Claims, 1 Drawing Sheet

CIGARETTE HAVING SIDESTREAM AROMA

REFERENCE TO RELATED APPLICATION

This application is a continuation-in-part of co-pending U.S. patent application Ser. No. 827,568 filed Feb. 10, 1986, now abandoned.

BACKGROUND OF THE INVENTION

This invention relates to smoking articles such as cigarettes, and in particular to cigarettes which produce sidestream smoke having a unique aroma.

Popular smoking articles such as cigarettes have a substantially rod shaped structure and include a charge of smokable material such as strands or shreds of tobacco (e.g., cut filler) surrounded by a paper wrapper thereby providing a so-called "tobacco rod." Numerous popular cigarettes have cylindrical filter elements aligned in an end-to-end relationship with the tobacco rod. Typically, filter elements are constructed from fibrous materials such as cellulose acetate, have a circumscribing plug wrap, and are attached to the tobacco rod using tipping material.

Cigarettes are employed by the user by burning one end thereof. The user then receives mainstream smoke into his/her mouth by drawing on the opposite end (e.g., filter end) of the cigarette. Typically, a person using a cigarette draws on or puffs the article about 5 to about 10 times, and each puff lasts about 0.5 second to about 2 seconds. Typically, a burning cigarette has a useful lifetime of from about 1 minute to about 10 minutes.

During the time that the cigarette is not being drawn upon by the user, it remains burning and sidestream smoke can be generated. Sidestream smoke is smoke which directly enters the atmosphere during the burning of a smoking article. Sidestream smoke diffuses into the atmosphere and the characteristic odor thereof may be perceived negatively by certain individuals.

Netherlands Patent Application No. 8102094 discloses a smoking article in the form of a cigar whereby the leaf wrapping is covered by microcapsules having an aromatic inner phase. In particular, it is disclosed that the heat at the burning end of the cigar causes the microcapsules to lose their structure and release the aromatic substance near the spot where the sidestream smoke ensues. However, the disclosed microcapsules are fairly large in size, and treatments such as matting are required in order to provide cigars having an acceptable appearance.

It would be highly desirable to provide a smoking article such as a cigarette (i) having an acceptable appearance which when employed by the user provides highly pleasant smelling sidestream smoke, and (ii) which delivers good tobacco taste to the user.

SUMMARY OF THE INVENTION

This invention relates to a cigarette having a charge of smokable (e.g., tobacco) material contained in circumscribing wrapping material. The wrapping material has in intimate contact therewith a flavor or aroma precursor in an amount sufficient to provide an alteration in aroma of the sidestream smoke of the cigarette upon burning during use thereof. The flavoring agent which results from dissociation of the the flavor precursor provides substantially less perceivable aroma characteristics to the mainstream smoke of the cigarette than to the sidestream smoke during use thereof. Such characteristics are provided due to the selected position of placement of flavor precursor within the smoking article. The flavor precursor provides essentially no perceivable aroma characteristics to the cigarette prior to use thereof.

As used herein, the term "flavor precursor" is meant a composition which includes a flavor or aroma moiety which is chemically reacted with another composition such that the resulting composition exhibits little or no aroma characteristics of the flavor moiety. Flavor precursors preferably include flavor moieties and substrates which are chemically reacted such that chemical decomposition of the composition yields a flavor or aroma characteristic.

The present invention allows the smoker to enjoy good tobacco taste upon smoking the cigarette while using a cigarette which can provide what can be perceived as highly pleasant smelling sidestream smoke. In particular, the aroma provided by the release of a flavoring agent by the flavor precursor during use of the cigarette can be such so as to override the odor of the ensuing sidestream smoke, and thereby suppress the odor thereof. Of particular interest are cigarettes which provide highly pleasant smelling sidestream smoke but which provide the substantially unaltered characteristic tobacco taste to the user. In particular, the taste of the mainstream smoke is complemented or not adversely affected by the flavoring agent. For example, the flavor characteristics provided to the mainstream smoke by the aroma precursor are not so overpowering so as to deleteriously affect or otherwise provide undesirable off-tastes to the mainstream smoke. Also of particular interest are cigarettes which exhibit the desirable aroma of conventional cigarettes prior to use while not exhibiting the characteristic odor of the flavoring agent.

DETAILED DESCRIPTION OF THE PREFERRED EMBODIMENTS

Figure 1:
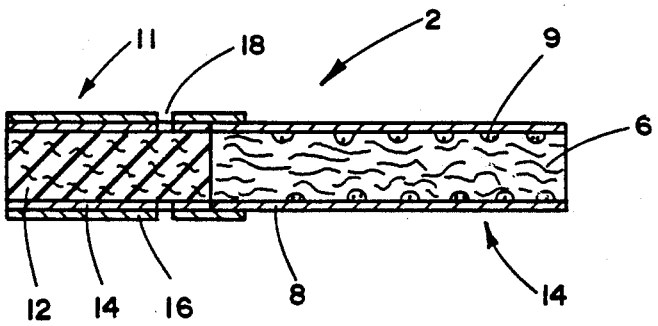
FIGS. 1 and 2 are diagrammatic cross sectional illustrations of cigarettes showing the filter region, the rod of smokable material, and the flavoring agent (shown as highly enlarged) in intimate contact with the inner surface of the wrapping material which circumscribes a charge of smokable material.

An embodiment of this invention shown in FIG. 1 is a smoking article 2 in the form of a cigarette. The cigarette comprises a generally cylindrical rod 4 of smokable material 6 contained in circumscribing outer wrapping material 8. Typically, the smokable material is a charge of tobacco, reconstituted tobacco, processed tobacco, tobacco substitute, or blend thereof. The smokable material generally is provided as conventionally employed in the manufacture of cigarettes (i.e., as shreds or strands of tobacco material provided at about 32 cuts per inch and treated with conventional additives such as flavorants). Typically, the wrapping material can include a conventional cigarette wrapping paper. Examples of wrapping materials are the commercially available flax-fiber calcium carbonate filter papers; and the commercially available wrapping materials which contain inorganic oxides and/or hydroxides such as magnesium oxide and/or magnesium hydroxide. Suitable cigarette wrapping papers are commercially available and Reference Nos. 719 and 856 from Kimberly-Clark Corp. or as Ecusta Experimental Nos. TOD 01788 or TOD 03363 from Ecusta Corp.

Wrapping material 8 comprises particles of flavor precursor 9 contacted with the outer surface thereof. Typically, the flavor precursor is held in contact with the wrapping material by containing means such as ethylcellulose, or the like. Most preferably the flavor is applied to the inner surface of the wrapping material and such that the flavor or aroma portion of the flavor precursor can easily diffuse into the sidestream smoke. The flavor precursor is shown as highly enlarged in FIG. 1. Most preferably the flavor precursor is essentially invisible to the naked eye (i.e., due to the small size or character of the flavor precursor particles) in order that the cigarette of this invention resembles a conventional cigarette. The ends of the rod are open to expose the smokable material. Rod 4 has a diameter comparable to that of a conventional cigarette, and generally ranges from about 5 mm to about 9 mm. Rod 4 has a longitudinally extending length comparable to the tobacco rod length of a conventional cigarette, and generally ranges from about 55 mm to about 85 mm.

The cigarette 2 further comprises filter element 11 positioned adjacent to one end of rod 4 such that the filter element is axially aligned with the rod in an end-to-end relation. Filter element 11 has a substantially cylindrical shape, and the diameter of the rod is substantially equal to the diameter of the filter element. Preferably, the filter element abuts the rod. The ends of the filter element are open to permit the passage of air and smoke therethrough. The filter element comprises filter material 12 which optionally is overwrapped with circumscribing wrap material 14. The wrap material can be a substantially air impermeable material or an air permeable material, and can include conventional plug wrap, or other types of paper wrap. The filter material can be a conventional cigarette filter material such as cellulose acetate, polypropylene, or the like; and the filter element can have a fibrous character, a molded shape, or other such configuration. The filter element has a longitudinally extending length comparable to the filter plug length of a conventional cigarette, and generally ranges from about 20 mm to about 35 mm.

Filter element 11 is attached to rod 4 by tipping material 16 which circumscribes both the filter element and an adjacent region of the rod. The inner surface of the tipping material is fixedly secured to the outer surface of the filter element and to the outer surface of the wrapping material of an adjacent region of the rod. The tipping material circumscribes the rod over a longitudinal length which can vary but is typically that length sufficient to provide good attachment of the filter element to the rod. Typically, the tipping material is either conventional air permeable tipping material or conventional essentially air impermeable tipping material. The tipping material can be tipping paper, or the like. If desired, openings 18 such as slits, holes, or perforations in the air permeable tipping material and in the underlying plug wrap can provide a means for air dilution of the cigarette.

Figure 2:
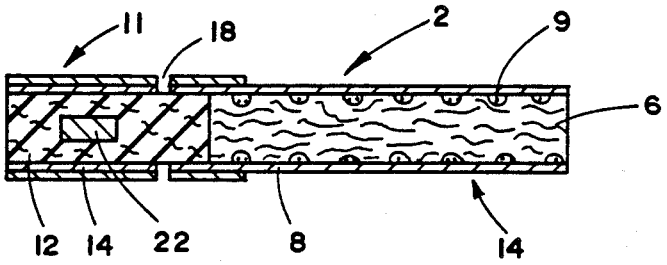

Referring to FIG. 2, filter element 11 can include, carry or contain a material for modifying the characteristics of the smoke which passes therethrough during draw. For example, the filter element can have a flavorant included therein, and the flavorant can be entrained in the mainstream smoke during draw upon the cigarette. Suitable flavorants include menthol, spearmint, cinnamon, citrus, cocoa, licorice, tobacco extract, and the like. The flavorant can be carried or contained in a pellet 22 which is positioned within the filter element 11. A suitable pellet has a cylindrical shape with a length of about 2.5 mm and a diameter of about 2.5 mm. Preferred flavor containing pellets are provided by subdividing a continuous strand of thermoplastic material (e.g., high density polyethylene). Examples of suitable strands containing flavorants are available from Applied Flavors and Fragrance Technologies, Inc., Mount Olive, N.J. as Menthol Strand P-1048 and Spearmint Strand P-1066. Also, suitable strands containing flavorants are available from International Flavors and Fragrances, Union Beach, N.J. as Polyiff Menthol Strand No. 35718 and Polyiff Spearmint Strand No. 60393. Suitable methods for providing filters with pellets positioned therein are disclosed by Greene et al in U.S. patent application Ser. No. 061,507 filed June 15, 1987, now U.S. Pat. No. 4,862,905, which is incorporated herein by reference.

The filter element can include, carry or contain the smoke modifying material in a variety of other ways. For example, the filter can have a flavored thread pass therethrough or a flavored tape wrapped therearound, as taught in U.S. Pat. No. 4,281,671 to Bynre et al. Alternatively, the filter material can be treated with flavorant as taught in U.S. Pat. Nos. 4,525,385; 4,476,807 and 4,549,875 to Pryor. Other methods for incorporating flavorants into filter elements will be apparent to the skilled artisan.

Desirable cigarette wrapping materials for certain cigarettes have relatively low inherent permeabilities and relatively high net permeabilities. By the term "inherent permeability" is meant the air flow porosity of the wrapping material itself. Typically, wrapping materials having low inherent permeabilities have porosities which are less than about 45 CORESTA units, preferably less than about 30 CORESTA units and more preferably about 15 CORESTA units or less. By the term "net permeability" is meant the air flow porosity of the wrapping material as used in manufacturing the tobacco rod. Typically, the air permeability is provided to the wrapping material using microlaser, mechanical or electrostatic perforation techniques. During microlaser and electrostatic perforation operations, it is most desirable that care be taken to maintain the desired color and opacity of the paper. For example, it is most desirable to minimize or avoid an unsightly "browning" or singeing of the paper.

Preferred such wrapping materials are paper wrapping materials which contain from about 10 to about 45 percent by weight of magnesium oxide and/or magnesium hydroxide, as well as flax, cellulose pulp, burn additives such as potassium citrate or potassium carbonate, and other materials such as fillers. Often, desirable paper wrapping materials contain more than about 15 percent by weight of magnesium oxide and/or magnesium hydroxide. Examples of suitable materials are described in U.S. Pat. Nos. 4,231,377 to Cline et al; 4,420,002 to Cline and 4,450,847 to Owens. Such wrapping materials are processed in order to have a relatively high net permeabilities. For example, wrapping materials having low inherent permeabilities can be perforated using conventional electrostatic perforating techniques (e.g., to provide individual perforations comparable in size to conventional electrostatically provided perforations) to obtain a wrapping material having a porosity of from about 50 to about 250 CORE- STA units, preferably from about 80 to about 140 CORESTA units, more preferably from about 90 to about 120 CORESTA units. A desirable paper wrap includes more than about 20 percent by weight of magnesium hydroxide, has an inherent permeability of from about 10 to about 30 CORESTA units, and is electrostatically perforated to provide a net permeability above about 45 CORESTA units.

The sizes of the individual perforations which provide for the high net permeabilities to such cigarette paper wrapping materials generally are such that the perforations are larger than the pores which are present in the naturally occurring paper wrap (i.e., which provide the inherent permeability to the paper). For aesthetics purposes, the individual perforations preferably are small enough to not be unsightly. For example, the perforations are not particularly noticeable, and in most instances are barely visible to the naked eye.

The cigarette rod 4, filter element 11 and ultimate cigarette 2 are manufactured using equipment and techniques which will be apparent to the skilled artisan.

Flavor precursors useful in this invention include those flavoring agents comprising an aromatic substance (e.g., an aromant). The aromatic substance includes a variety of commercially available flavors, which provide the desired aroma or odor to the sidestream smoke during use of the cigarette to which the flavoring agent is applied. Particularly desirable aromatic substances include those substances which provide odors comparable to the odor which is provided by vanillin or cinnamon, or which provide floral or fruity odor characteristics.

The aromatic substance is chemically reacted with another material such that the aromatic substance exhibits little or no perceivable aroma characteristics. Examples of suitable flavor precursors are metal salts of fragrant organic acids; acetals from fragrant aldehydes and Schiff bases of fragrant aldehydes and fragrant ketones. The material which is the substrate for the aromatic substance preferably is an organic material which essentially prevents release of aromatic substance prior to the time that the cigarette is burned during use. In particular, the substrate material minimizes migration of the aromatic substance prior to use of the cigarette. It is most preferable that the substrate not provide an undesirable perceivable taste or odor to the cigarette either prior to or during use thereof.

Examples of suitable organic substrates are sugars having hydroxy moieties which can chemically react with moieties of an aromant. An example of a suitable sugar is glucose. Such substrates can chemically react with certain flavoring agents to provide the flavor precursor.

Examples of suitable flavor precursors are available from Fritzsche Dodge & Olcott, unit of BASF K&F, New York, N.Y. as experimental compound Nos. FM-2246, FM-2249-A and FM-2193.

Typically, cigarettes of this invention are lit for use, and the heat of the resulting fire cone causes the flavor precursor or aroma precursor to dissociate under the influence of the locally prevalent high temperature. The dissociation of the flavor precursor causes the aromatic substance to be released into the atmosphere. Generally, the aromatic substance is released in a vaporized state in or near that portion of the cigarette where sidestream smoke ensues. Thus, upon release of the aromatic substance, the flavor precursor provides a much more highly perceivable aroma characteristic than when the flavoring agent is reacted with the substrate as a flavor precursor.

Typically, the amount of flavor precursor applied to conventional cigarette paper ranges from about 0.1 percent to about 10 percent preferably 0.5 percent to 1.5 percent, based on the weight of the cigarette paper. The amount of aromatic substance employed per cigarette depends upon factors such as the aromatic characteristics thereof, the thermal stability thereof, the amount of sidestream smoke generated by the cigarette during use, the character of the odor of the sidestream smoke, and the like.

The manner in which the flavoring agent is applied to the wrapping material can vary. For example, the wrapping material can be manufactured with the flavor precursor therein (e.g., impregnated therein or as a film). Alternatively, the flavor precursor can be electrostatically deposited on the wrapping material. Preferably, the flavor precursor is adhesively secured (e.g., with glue) to the surface or a portion of the surface of the wrapping material. For example, the flavor precursor can be adhesively secured to the outer surface of the wrapping material, the inner surface of the wrapping material, along or within the glue line which extends along the length of the cigarette; printed as a patterned application such as provided by a wheel applicator; applied using a size press or other sizing process; or the like. Common glues include ethylene-vinylacetate copolymer emulsions, polyvinylacetate emulsions, polyvinylalcohol solutions, vegetable starches, dextrins, cellulosic adhesives, and the like. The flavor precursor can be applied, dispersed in a mixture of ethylcellulose and water or a mixture of carboxy methylcellulose and water. Yet another method can include a printing technique whereby the flavor precursor is incorporated into an inking solution and applying the ink to the wrapping material using a Gravure printing process, or the like.

Figure 3:
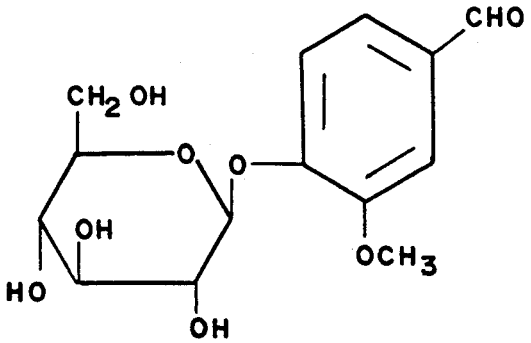
FIGS. 3 and 4 are diagrammatic illustrations of the formulas of a flavor precursors useful in this invention.
Figure 4:
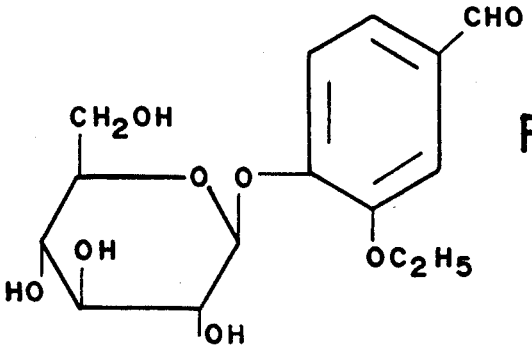

Referring to FIGS. 3 and 4, the chemical formula of a preferred flavor precursor is shown. The flavor precursor shown in FIG. 3 is known as vanillin glucoside. The flavor precursor shown in FIG. 4 is known as ethyl vanillin glucoside. Such flavor precursors exhibit essentially no odor in flavor precursor form. The precursors are dispersible in aqueous media for easy application to cigarette paper wrapping and have a nonhygroscopic character. Such precursors readily decompose during temperatures experienced in the vicinity of the fire cone of cigarette to yield vanillin aroma.

Flavor precursors can be readily prepared by contacting beta-D-glucose penta acetate a haloacid and acetic acid to obtain to alpha-halo glucose tetra acetate. The alpha-halo glucose tetra acetate is contacted with ethyl vanillin and a weak base such as a carbonate in a solvent such as acetone to yield ethoxy vanillin glucose tetra acetate. The exthoxy vanillin glucose tetra acetate is contacted with a mixture of hydroxide and methanol to yield the ethyl vanillin glucoside having the formula shown in FIG. 4.

The following examples are provided in order to further illustrate preferred aspects of the invention but should not be construed as limiting the scope thereof. Unless otherwise noted, all parts and percentages are by weight.

EXAMPLE 1

Cigarettes having lengths of about 98 mm and circumferences of about 22.55 mm have tobacco rod lengths of 67 mm and filter element lengths of 31 mm.

The tobacco rod includes a charge of tobacco cut filler contained in a circumscribing cigarette paper wrap. The filler material employed in providing the tobacco rod is in the form of shreds or strands cut at about 32 cuts per inch. The filler material includes a blend of about 25 percent flue-cured tobacco, about 20 percent flue-cured and Burley tobaccos which have been volume expanded, about 25 percent Oriental tobacco blend, about 5 percent Burley tobacco and about 25 percent reconstituted tobacco. The blend has a water, flavoring and glycerin casing applied thereto.

The paper wrap is sold commercially as Ecusta Experimental No. TOD 03363 by Ecusta Corp. The paper wrap is a heavy weight sheet, low visible sidestream paper, and contains about 40 percent magnesium oxide. The paper has an inherent permeability of 15 CORESTA units and a basis weight of 45 g/m$^2$. The paper is electrostatically perforated in order to yield a net permeability of 110 CORESTA units. The individual perforations each have a size comparable to conventional electrostatic perforations in conventional cigarette wrap, and are positioned with about 1 to about 10 perforations/mm essentially linearly in the longitudinal direction such that the lines of perforations are positioned about 1 mm to about 3 mm apart. The paper has about 2 milligrams of ethyl vanillin glucoside applied thereto using a size press technique.

The filter element is manufactured using conventional cigarette filter making technology from cellulose acetate tow (3.6 denier per filament, 31,000 total denier) and circumscribing air permeable paper plug wrap.

Within the filter element is positioned a cylindrical spearmint flavored pellet of 2.5 mm length and 2.5 mm diameter. The pellet is provided from a strand of flavored thermoplastic available from International Flavors and Fragrances as Polyiff Spearmint Strand No. 60393.

The tobacco rod and filter element have similar circumferences, are aligned in an abutting, end-to-end relationship, and are secured together using tipping paper. The tipping paper is adhesively secured to the filter element and the adjacent portion of the tobacco rod. The tipping material circumscribes the length of the filter element and about 3 mm of the length of the tobacco rod. Cigarettes so described are manufactured using a Hauni Protos Cigarette Maker from Hauni-Werke Korber & Co. KG. A ring of mechanically provided perforations thus providing the permeability extends around the periphery of the cigarette about 26 mm from the extreme mouthend thereof. The perforations so provided yield cigarettes with about 53 percent air dilution.

The cigarette is smoked under FTC conditions. The cigarette yields 7.3 mg FTC "tar", 0.72 mg nicotine, 6.4 mg carbon monoxide, 37 micrograms nitrogen oxides, and a puff count of 9.8.

The cigarette is smoked and delivers a rich tobacco flavor as well as an acceptable draft resistance. The mainstream aerosol is not harsh and the cigarette yields desirable smoking satisfaction. Upon exhale of the drawn smoke, the user experiences the taste characteristic of spearmint. Also, the cigarette yields low amounts of visible sidestream smoke. The cigarette provides the odor of vanillin during use. The vanillin odor is provided to the sidestream smoke. The mainstream smoke exhibits tobacco taste and does not have any overwhelming taste characteristic of vanillin.

EXAMPLE 2

Cigarettes having lengths of about 84 mm and circumferences of about 24.85 mm have tobacco rod lengths of 57 mm and filter element lengths of 27 mm. The tobacco rod includes a charge of tobacco cut filler contained in a circumscribing cigarette paper wrap. The filler material employed in providing the tobacco rod is generally described in Example 1.

The paper wrap is sold commercially as Ecusta Experimental No. TOD 03363 by Ecusta Corp., and is described in Example 1. About 2 mg ethyl vanillin glucoside is applied to the paper using a size press technique.

The filter element is manufactured using conventional cigarette filter making technology from cellulose acetate tow (2.7 denier per filament, 46,000 total denier) and circumscribing air permeable paper plug wrap.

The tobacco rod and filter element have similar circumferences, are aligned in an abutting, end-to-end relationship, and are secured together using tipping paper. The tipping paper is adhesively secured to the filter element and the adjacent portion of the tobacco rod. The tipping material circumscribes the length of the filter element and about 3 mm of the length of the tobacco rod. Cigarettes so described are manufactured using a Hauni Protos Cigarette Maker from Hauni-Werke Korber & Co. KG. A ring of mechanically provided perforations thus providing the permeability extends around the periphery of the cigarette about 26 mm from the extreme mouthend thereof. The perforations so provided yield cigarettes with about 30 percent air dilution.

The cigarette is smoked under FTC conditions. The cigarette yields 9.8 mg FTC "tar", 0.69 mg nicotine, 17.27 mg carbon monoxide, and a puff count of 9.0.

The cigarette is smoked and delivers a rich tobacco flavor as well as an acceptable draft resistance. The mainstream aerosol is not harsh and the cigarette yields desirable smoking satisfaction. Also, the cigarette yields low amounts of visible sidestream smoke. The sidestream smoke of the cigarette exhibits a vanillin odor. The mainstream smoke exhibits tobacco taste and does not have any overwhelming taste characteristic of vanillin.

What is claimed is:

1. A cigarette comprising smokable material contained in circumscribing wrapping material, the wrapping material having in intimate contact therewith a flavor precursor in an amount sufficient to provide alteration to the aroma of the sidestream smoke of the cigarette upon burning during use thereof; wherein the flavor precursor provides substantially less perceivable aroma characteristics to the mainstream smoke of the cigarette than to the sidestream smoke during use thereof, and wherein the flavor precursor provides essentially no perceivable aroma characteristics to the cigarette prior to use thereof.

2. The cigarette of claim 1 wherein the flavor precursor is so employed in an amount from 0.1 mg to 1.0 mg per cigarette.

3. The cigarette of claim 1 wherein the flavor precursor is so employed in an amount from 0.5 mg to 1.5 mg per cigarette.

4. The cigarette of claim 1 further comprising a filter element.

5. The cigarette of claim 1 further comprising a filter element which includes a smoke modifying agent.

6. The cigarette of claim 5 wherein the smoke modifying agent is a flavorant.

7. The cigarette of claim 6 wherein the flavorant is carried by a pellet positioned within the filter element.

8. The cigarette of claim 6 or 7 wherein the flavorant is spearmint.

9. The cigarette of claim 1, 5 or 6 wherein the wrapping material is a flax fiber-calcium carbonate paper.

10. The cigarette of claim 9 wherein the flavor precursor is impregnated within the wrapping material.

11. The cigarette of claim 1, 5 or 6 wherein the wrapping material includes magnesium oxide and/or magnesium hydroxide.

12. The cigarette of claim 11 wherein the flavor precursor is impregnated within the wrapping material.

13. The cigarette of claim 1 wherein the flavor precursor is impregnated within the wrapping material.

14. The cigarette of claim 1 wherein the flavor precursor is secured to the outer surface of the wrapping material.

15. The cigarette of claim 1 wherein the flavor precursor is positioned within the glue line which extends along the length of the cigarette.

16. The cigarette of claim 1 wherein the flavor precursor is secured to the inner surface of the wrapping material.

17. A cigarette comprising material contained in circumscribing paper wrapping material; the wrapping material (i) containing inorganic oxide and/or inorganic hydroxide and having an inherent permeability of less than about 45 CORESTA units and a net permeability of greater than about 50 CORESTA units, and (ii) having in intimate contact therewith a flavor precursor in an amount sufficient to provide alteration to the aroma of the sidestream smoke of the cigarette upon burning during use thereof; wherein the flavor precursor provides substantially less perceivable aroma characteristics to the mainstream smoke of the cigarette than to the sidestream smoke during use thereof, and wherein the flavor precursor provides essentially no perceivable aroma characteristics to the cigarette prior to use thereof.

18. The cigarette of claim 17 wherein the wrapping material is a paper wrapping material containing magnesium oxide and/or magnesium hydroxide.

19. The cigarette of claim 18 wherein the paper wrapping material has a basis weight of about 20 $g/m^2$; and the magnesium oxide and/or magnesium hydroxide contained therein ranges from about 10 percent to about 45 percent, based on the total weight of the wrapping material.

20. The cigarette of claim 18 wherein the paper wrapping material has been electrostatically perforated so as to have a net permeability greater than about 80 CORESTA units.

21. The cigarette of claim 18, 19 or 20 further comprising a filter element which includes a smoke modifying agent.

22. The cigarette of claim 18, 19 or 20 further comprising a filter element which includes a flavorant.

23. The cigarette of claim 22 wherein the flavorant is carried by a pellet positioned within the filter element.

24. The cigarette of claim 23 wherein the flavorant is spearmint.

25. The cigarette of claim 17 wherein the flavor precursor is impregnated within the wrapping material.

26. The cigarette of claim 17 wherein the flavor precursor is secured to the outer surface of the wrapping material.

27. The cigarette of claim 17 wherein the flavor precursor is positioned within the glue line which extends along the length of the cigarette.

28. The cigarette of claim 17 wherein the flavor precursor is secured to the inner surface of the wrapping material.

* * * * *